US008752865B1

(12) United States Patent
Coogle

(10) Patent No.: US 8,752,865 B1
(45) Date of Patent: Jun. 17, 2014

(54) REFRIGERATION CONDENSATE LINE MAINTENANCE KIT

(76) Inventor: Gregory Coogle, Pembroke Pines, FL (US)

( * ) Notice: Subject to any disclaimer, the term of this patent is extended or adjusted under 35 U.S.C. 154(b) by 189 days.

(21) Appl. No.: 13/317,004

(22) Filed: Oct. 7, 2011

(51) Int. Cl.
*F16L 25/00* (2006.01)

(52) U.S. Cl.
USPC ..... 285/12; 137/240; 137/271

(58) Field of Classification Search
USPC ..... 137/269, 270, 271, 240; 285/12
See application file for complete search history.

(56) References Cited

U.S. PATENT DOCUMENTS 5,085,244 A * 2/1992 Funk ..... 137/240
5,375,887 A * 12/1994 Johnson ..... 285/12
5,390,691 A * 2/1995 Sproule ..... 137/1
5,603,228 A * 2/1997 Barthold et al. ..... 137/240
6,651,690 B1 11/2003 Coogle
6,683,535 B1 1/2004 Utke
6,708,717 B1 3/2004 Coogle
6,932,104 B2 * 8/2005 Anderson et al. ..... 137/271
7,624,756 B1 12/2009 Coogle
7,905,250 B2 * 3/2011 Noll et al. ..... 137/269
7,930,898 B2 * 4/2011 Laufenberg et al. ..... 62/285
8,156,956 B1 * 4/2012 Coogle ..... 137/271
8,479,760 B2 * 7/2013 Eads ..... 137/240
2005/0110269 A1 * 5/2005 Chu et al. ..... 285/12

* cited by examiner

*Primary Examiner* — David E Bochna
(74) *Attorney, Agent, or Firm* — Alvin S. Blum

(57) ABSTRACT

A drain pan collects condensate water from an air conditioner. A drain line includes an elbow connecting the pan to a vertical pipe that drains the condensate water to outside. The drain line must be periodically cleaned to prevent clogging. A kit and method is provided to modify the drain line so that it can then be cleaned more easily, and components are provided to facilitate the drain line cleaning process.

6 Claims, 7 Drawing Sheets

REFRIGERATION CONDENSATE LINE MAINTENANCE KIT

FIELD OF THE INVENTION

This invention relates generally to air conditioning apparatus and more particularly to apparatus and methods for maintenance of the water line that drains water from a pan that receives water that condenses on the evaporator coils of an air conditioning system.

BACKGROUND OF THE INVENTION

It is well known in the art to provide a receptacle such as a tray or pan beneath the evaporator coils of an air conditioner to receive water that condenses from the air as it is cooled. A drain pipe line is generally connected to a side wall of the tray to drain the condensate water as it accumulates. The drain pipe line is commonly a horizontal pipe connected to the pan followed by an elbow, then a vertical line. The vertical line generally terminates outside the building in a water trap to drain to the atmosphere. The line is commonly formed of either one inch or three quarter inch rigid pipe, but other sizes may be used. Because water may stand still in the system, various microorganisms may grow in the tray and drain pipe until they clog up the drainage system. When this occurs, water overflowing from the tray may cause considerable damage. Because the drainage system and tray are out of sight and may be relatively inaccessible, they may be neglected until damage occurs. Clearing obstructions in the drain line and routine maintenance of the drain line are now generally done by manually disconnecting the drain line and blowing out, or sucking out, obstructions. The drain line is then reconnected. A less labor intensive and convenient system would encourage routine maintenance and avoid complete blockage.

SUMMARY OF THE INVENTION

It is accordingly an object of the invention to provide an assembly or kit for service personnel to facilitate maintenance. The kit supplies all of the necessary items that enable the service person to modify the drainage system so that it is then much easier to clean out the drain line by forcing fluids through it on this visit and on future visits. A first unit of the kit is a flexible connector adapted to fit onto the rigid pipe after a portion of the pipe line has been permanently cut away. The flexible connector is open at both ends. Each end is provided with a hose clamp to make a water-tight seal of the connector to restore the integrity of the drain line after the portion of the original pipe line has been cut away. The flexible connector may be straight to replace a straight section of drain pipe or an elbow to replace an elbow section of drain pipe. A proximal end of the flexible connector is easily disconnected from the pipe line when it is desired to clean out the line. A rigid straight connector has a first open end adapted for fluid tight insertion into the opened end of the flexible connector. The second open end of the rigid straight connector is provided with a threaded female water hose coupling. This is also termed a garden hose connector. The kit then provides the service person with four different options for clearing the drain line by providing three different fluid adapters, each of which simply screws into the female water hose coupling on the second end of the rigid connector fitted onto the flexible connector. Each fluid adapter has the male water hose connection at a first end, and the second end has one of:

1. A barbed tube for connection to a resilient tube that may supply fluid such as air or liquid to dislodge and/or wash away an obstruction or flush the drain line.

2. A compressed gas tire valve housing for delivering compressed gas.

3. A tapered funnel adapted to receive the nozzle of a wet vacuum/blower hose.

A fourth option uses a garden hose for forcing water through the line. The conventional garden hose terminates in a male water hose connection.

After the line is cleared, the rigid connector is pulled from the end of the flexible connector, after the hose clamp is loosened. The free end of the flexible connector is then forced onto the drain line and secured with the hose clamp to restore the integrity of the drain line until the next maintenance visit.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Figure 1:
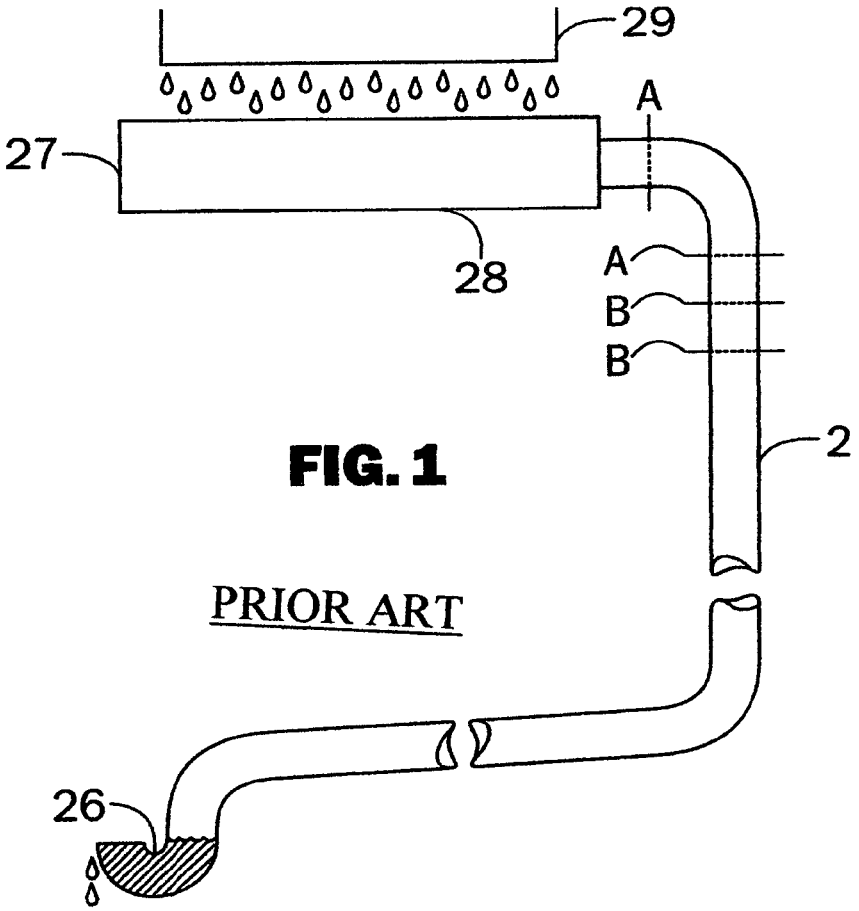
FIG. 1 PRIOR ART
FIG. 1 is a side elevation view of a condensate drain line of the prior art.

Referring now first to the drawing FIG. 1, a prior art drain line pipe 5 is in fluid communication with side 27 of a pan 28. The pan receives atmospheric water that condenses on the evaporator coils 29 of an air conditioning unit (not shown). The drain line 5 may have a variety of configurations and pipe sizes to fit a particular installation. It starts with an elbow 1 at the pan 28, and connects to a vertical pipe 2. The line terminates with a water trap 26 that empties water outside the building. Marks A-A indicate where the elbow is cut away to install a flexible elbow of the invention. Marks B-B indicate where a straight portion of the vertical pipe is cut away to install a flexible straight connector of the invention. A decision will be made to install only one of these flexible connectors, based upon the physical conditioned found by the user.

Figure 2:
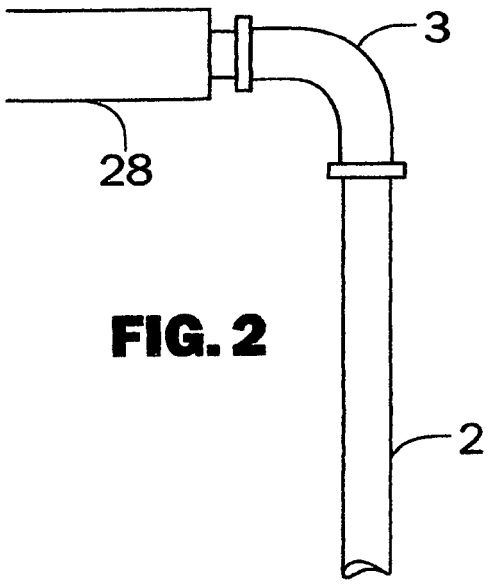
FIG. 2 is a side elevation view of the condensate drain line after the elbow has been replaced and maintenance completed.

FIG. 2 illustrates the condition of the drain line pipe 5 after pipe elbow 1 has been cut away, a flexible elbow 3 has been installed, and the maintenance completed.

Figure 3:
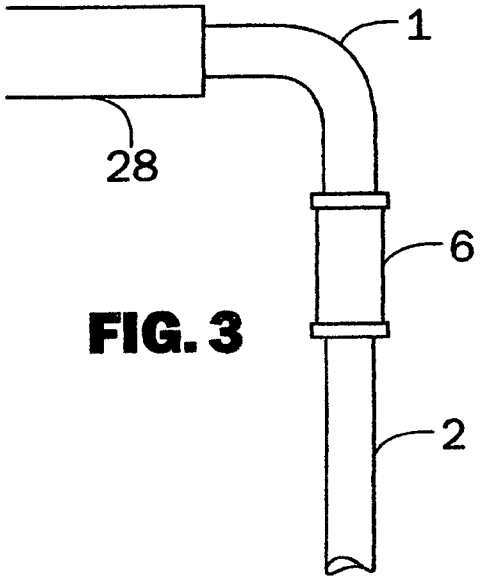
FIG. 3 is a side elevation view of the condensate drain line after a vertical section has been replaced and maintenance completed.

FIG. 3 illustrates the drain line pipe after a portion of straight pipe 2 has been cut away, the flexible straight connector 6 has been installed, and the maintenance completed.

Figure 4:
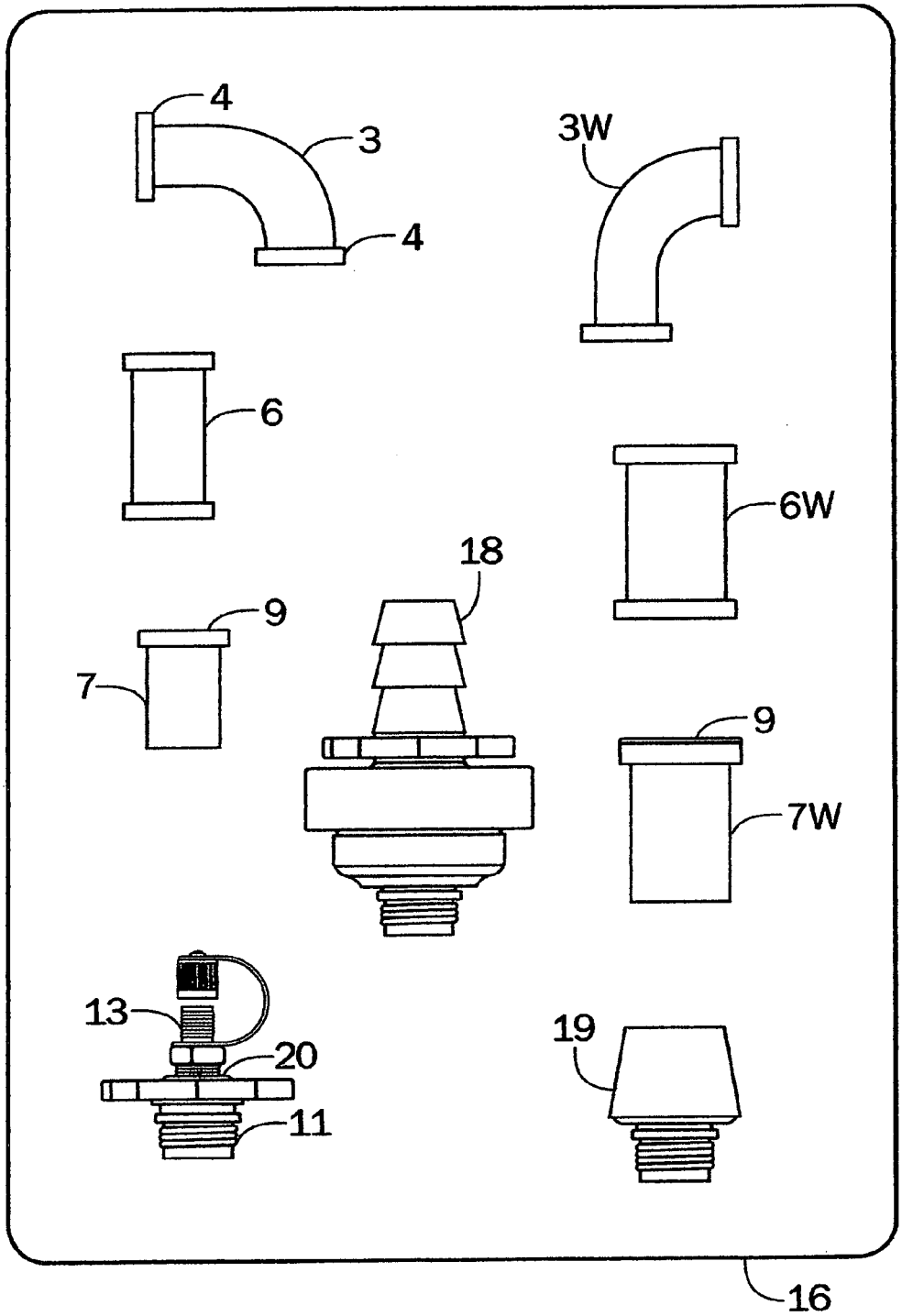
FIG. 4 is a plan view of a kit of the invention.

FIG. 4 illustrates a portable maintenance kit 16 of the invention that is supplied to a person servicing air conditioning equipment. The kit supplies, within an internal volume 17, all the special materials needed to modify an air conditioning drainage pipe system for easier cleaning. At present, most systems employ three quarter inch pipe or one inch pipe. The kit provides materials to modify those pipes. In future, items for other pipe sizes may then be included. The kit includes: a flexible elbow 3 having a hose clamp 4 at each open end, and a straight connector 6 with a hose clamp 4, at each open end, both for three quarter inch pipe, and flexible elbow 3*w* and flexible straight connector 6*w*, both for one inch pipe; a rigid straight connector 7 having a first open end adapted to fit snugly into an open end of either elbow 3 or straight connector 6, and a second open end having a threaded female water hose coupling; a rigid straight connector 7*w* having a first open end adapted to fit snugly into an open end of either elbow 3*w* or straight connector 6*w*, and a second open end having a threaded female water hose coupling 9; a rigid fluid connector 10 having a first open end provided with a threaded male water hose coupling 11 and a second open end provided with a barbed tube 18 for a resilient hose; a rigid fluid connector 12 having a first open end provided with a threaded male water hose coupling 11 and a second open end provided with a tapered funnel 19 adapted for receiving a hose nozzle from a wet vacuum/blower; and a rigid fluid connector 13 having a first open end provided with a threaded male water hose coupling 11 and a second open end provided with a compressed gas tire valve housing 20.

Figure 5:
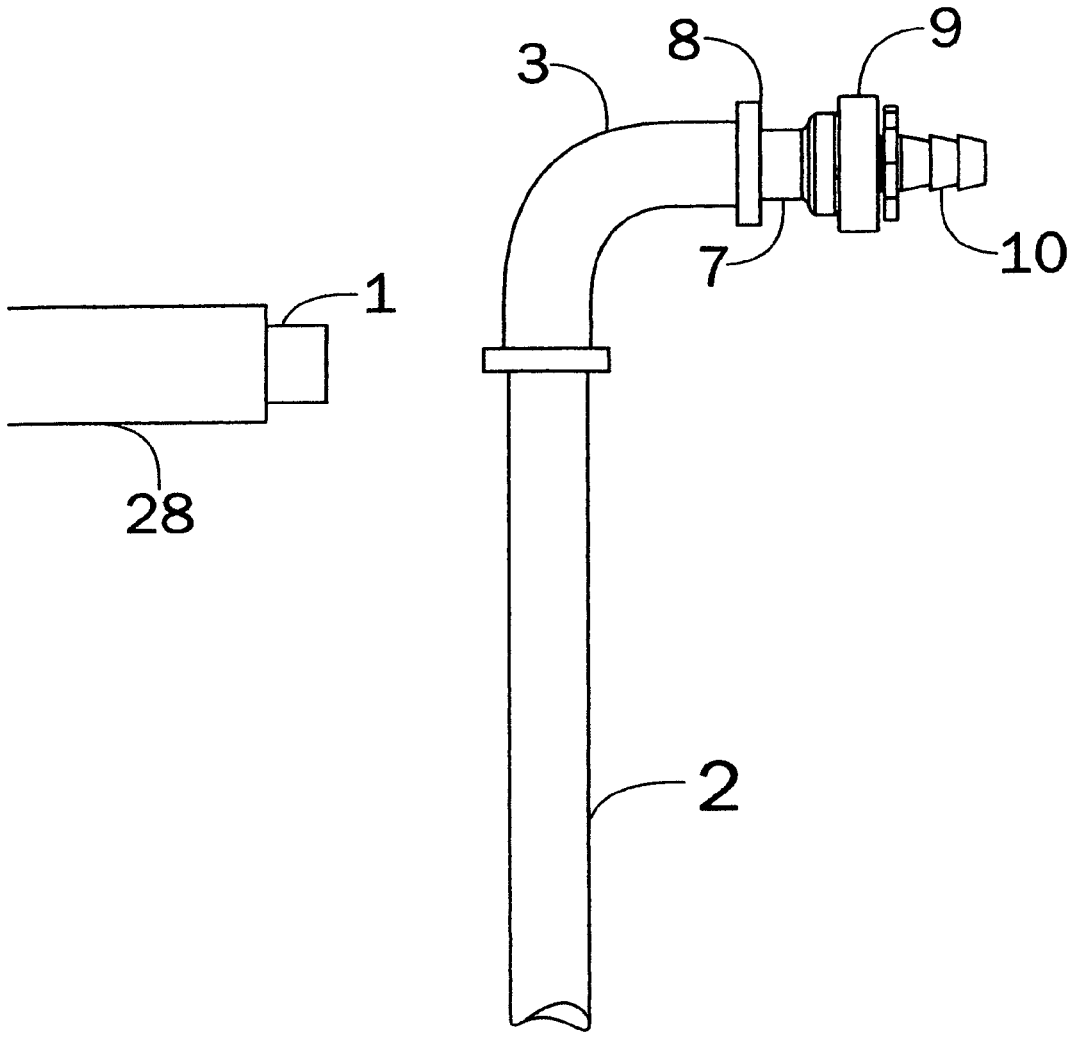
FIG. 5 is a side elevation view of a portion of the condensate drain line after elbow has been replaced and ready for maintenance with barbed tube in place.

FIG. 5 illustrates the use of the invention preparatory to clearing the drain line with a fluid source terminating in a resilient tube, when flexible elbow 3 has been installed. The elbow 3 is released at its upper end, rotated, and rigid straight connector 7 inserted by a first end 8 into the free end of elbow 3 to make a fluid tight connection. A second end of connector 7 provides a female water hose coupling 9. A rigid fluid connector 10 has a male water hose coupling 11 at a first end and a barbed tube 18 at a second end to receive a resilient tube to force cleaning fluid through the line from a source of fluid (not shown).

Figure 6:
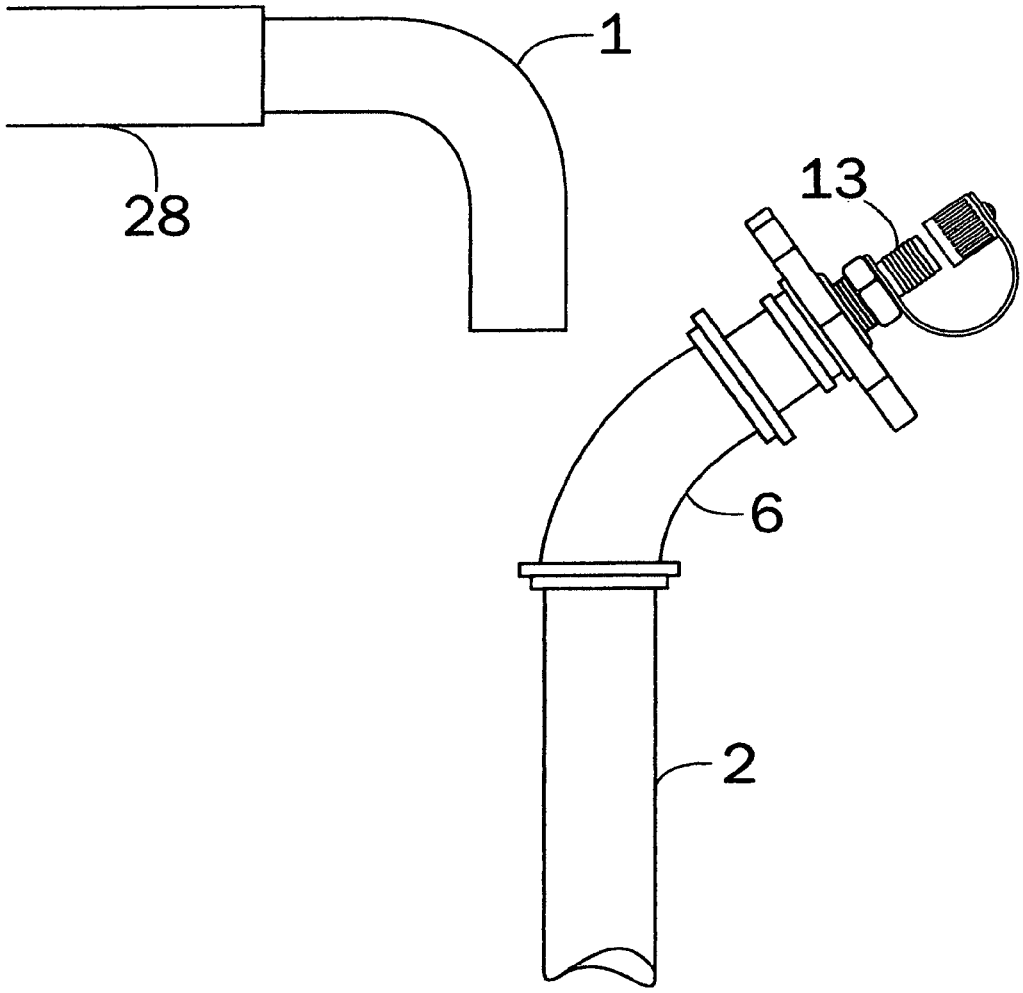
FIG. 6 is a side elevation view of a portion of the condensate drain line after a straight section has been replaced and ready for maintenance with tire valve housing in place.

FIG. 6 is a side elevation view of a portion of the condensate drain line 2 after a straight section has been replaced by flexible straight connector 6 and ready for maintenance with tire valve housing fluid connector 13 in place.

Figure 7:
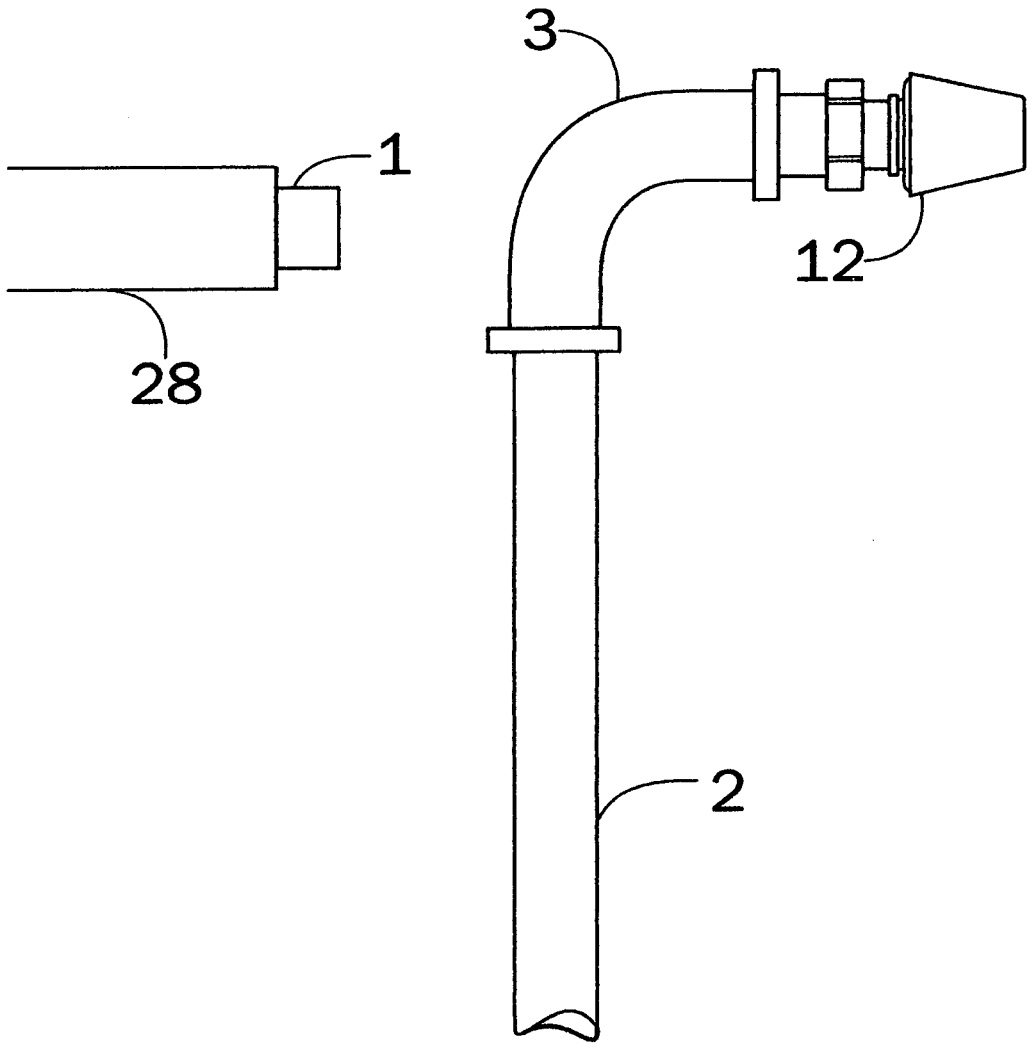
FIG. 7 is a side elevation view of a portion of the condensate drain line after elbow section has been replaced and ready for maintenance with the tapered funnel in place.

FIG. 7 is a view of a portion of the condensate drain line after elbow section 1 has been replaced by flexible elbow 3 and rigid straight connector 7, and ready for maintenance with the tapered funnel fluid connector 12 in place ready to receive a hose nozzle (not shown) from a wet vacuum/blower.

Figure 8:
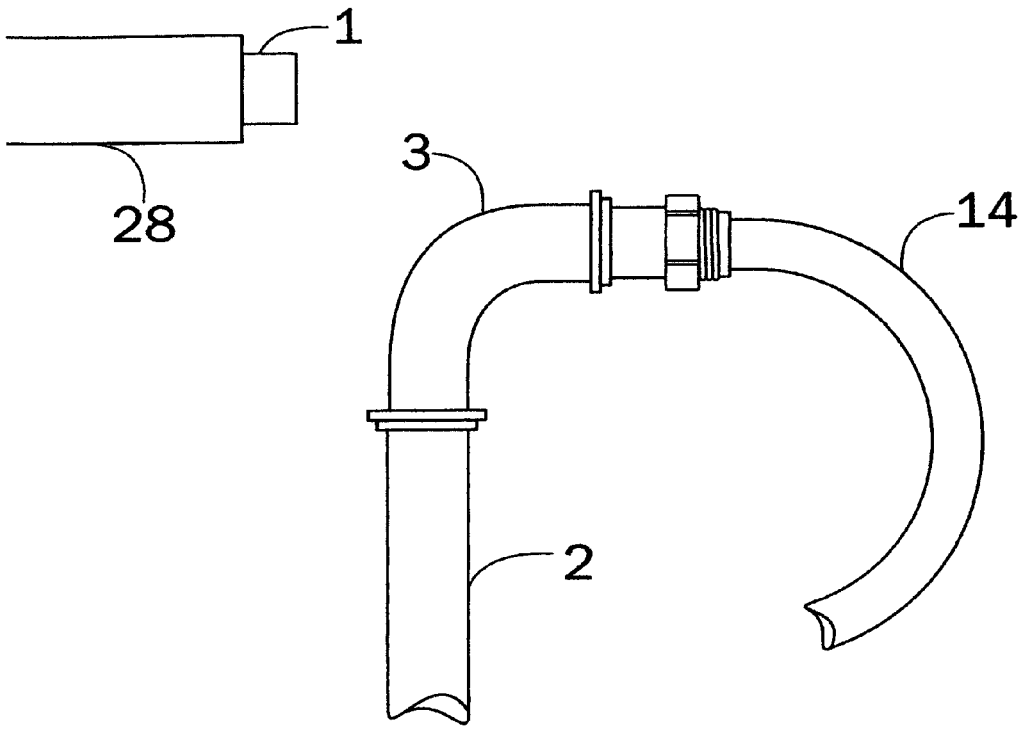
FIG. 8 is a side elevation view, partially cut away, of a portion of the condensate drain line after elbow section has been replaced and ready for maintenance with a garden hose in place.

FIG. 8 is a view of a portion of the condensate drain line after elbow section 1 has been replaced by elbow 3 and rigid straight connector 7, and ready for maintenance with garden hose 14.

Figure 9:
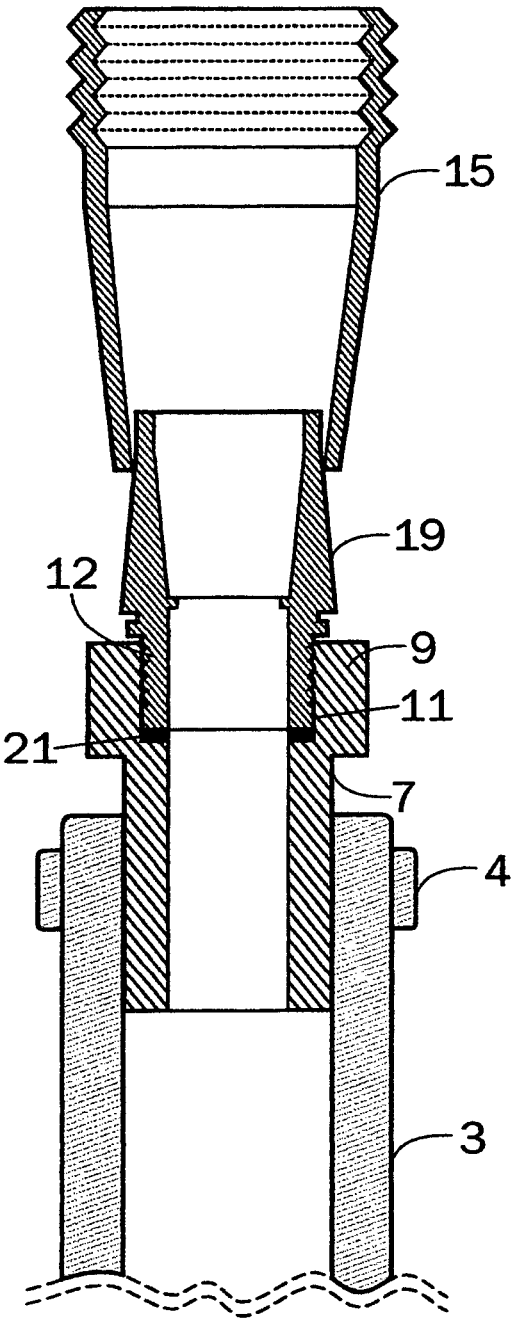
FIG. 9 is a sectional detail of a portion of FIG. 7 with nozzle in place.

FIG. 9 is a sectional detail of a portion of FIG. 7 with hose nozzle 15 from a wet vacuum blower (not shown) in place on tapered funnel end 19 of fluid connector 12. The male water hose coupling end 11 of connector 12 fits securely in the female coupling end of straight connector 7 which is sealingly engaged in the free end of flexible elbow 3. The joint between male and female couplings is provided with a resilient washer 21.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A kit for facilitating maintenance of a drain line pipe that drains condensate water from a pan beneath an evaporator, the pipe being three quarter inch pipe or one inch pipe, the kit comprising:

a portable container having an internal volume;

the internal volume containing:

a flexible elbow having a hose clamp at each open end adapted to be sealingly connected to three quarter inch pipe;

a flexible elbow having a hose clamp at each open end adapted to be sealingly connected to one inch pipe;

a flexible straight connector having a hose clamp at each open end adapted to be sealingly connected to three quarter inch pipe;

a flexible straight connector having a hose clamp at each open end adapted to be sealingly connected to one inch pipe;

a rigid straight connector having a first open end adapted for fluid tight insertion into an open end of the flexible connector for three quarter inch pipe and a second open end provided with a threaded female water hose coupling;

a rigid straight connector having a first open end adapted for fluid tight insertion into an open end of the flexible connector for one inch pipe and a second open end provided with a threaded female water hose coupling; and a rigid fluid connector having a first open end provided with a threaded male water hose coupling and a second open end provided with a barbed tube for a resilient hose;

a rigid fluid connector having a first open end provided with a threaded male water hose coupling and a second open end provided with a tapered funnel adapted for receiving a hose nozzle from a wet vacuum/blower.

2. The kit according to claim 1 in which the flexible connectors are made of material resistant to oxidation.

3. The kit according to claim 1 further comprising:

a rigid fluid connector having a first open end provided with a threaded male water hose coupling and a second open end provided with a compressed gas tire valve housing.

4. A kit for facilitating maintenance of a rigid drain line pipe that drains condensate water from a pan beneath an evaporator, the kit comprising:

a flexible connector having a hose clamp at each open end adapted to be sealingly connected to the drain line pipe;

a rigid straight connector having a first open end adapted for fluid tight insertion into an open end of the flexible connector and second open end provided with a threaded female water hose coupling;

a fluid connector having a first open end provided with a threaded male water hose coupling adapted for fluid tight connection to the rigid straight connector for fluid cleaning of the drain line pipe and a second open end provided with a barbed tube for a resilient hose; and a fluid connector having a first open end provided with a threaded male water hose coupling adapted for fluid tight connection to the rigid straight connector for fluid cleaning of the drain line pipe and a second open end provided with a tapered funnel adapted for receiving a hose nozzle from a wet vacuum/blower.

5. The kit according to claim 4 in which the flexible connectors are made of material resistant to oxidation.

6. The kit according to claim 4 further comprising:

a rigid fluid connector having a first open end provided with a threaded male water hose coupling and a second open end provided with a compressed gas tire valve housing.

* * * * *